US010911847B2

(12) United States Patent
Kenaley et al.

(10) Patent No.: US 10,911,847 B2
(45) Date of Patent: Feb. 2, 2021

(54) PRESSURE EQUALIZING CONSTRUCTION FOR NONPOROUS ACOUSTIC MEMBRANE

(71) Applicant: W. L. Gore & Associates, Inc., Newark, DE (US)

(72) Inventors: Ryan Kenaley, Hockessin, DE (US); Michael Ringquist, Elkton, MD (US)

(73) Assignee: W. L. Gore & Associates, Inc., Newark, DE (US)

( * ) Notice: Subject to any disclaimer, the term of this patent is extended or adjusted under 35 U.S.C. 154(b) by 307 days.

(21) Appl. No.: 16/090,785

(22) PCT Filed: Apr. 6, 2017

(86) PCT No.: PCT/US2017/026339
§ 371 (c)(1),
(2) Date: Oct. 2, 2018

(87) PCT Pub. No.: WO2017/176989
PCT Pub. Date: Oct. 12, 2017

(65) Prior Publication Data

US 2020/0329289 A1 Oct. 15, 2020

Related U.S. Application Data

(60) Provisional application No. 62/319,114, filed on Apr. 6, 2016.

(51) Int. Cl.
*H04R 1/02* (2006.01)

(52) U.S. Cl.
CPC ..... *H04R 1/02* (2013.01)

(58) Field of Classification Search
CPC ..... H04R 1/02
See application file for complete search history.

(56) References Cited

U.S. PATENT DOCUMENTS

2013/0308809 A1 11/2013 Thompson et al.
2015/0163572 A1 6/2015 Weiss et al.
2015/0304767 A1* 10/2015 Mori ..... H04M 1/03 381/334

(Continued)

FOREIGN PATENT DOCUMENTS

CN 105120385 A 12/2015
JP 2007184952 7/2007

(Continued)

OTHER PUBLICATIONS

Catalog of Premier D compact flow tester manufactured by ATEQ.

(Continued)

*Primary Examiner* — Brian Ensey
(74) *Attorney, Agent, or Firm* — Greenebrg Traurig, LLP

(57) ABSTRACT

A pressure equalizing assembly with a nonporous membrane traversing across an acoustic pathway defined by an opening in a housing. A breathable layer connected to the nonporous membrane may be laterally arranged to the acoustic pathway. An acoustic cavity is defined by the breathable layer and nonporous membrane. The nonporous membrane has a side facing the opening in the housing to prevent fluid or moisture from penetrating into the acoustic cavity. The breathable layer further equalizes pressure in the acoustic cavity by providing a venting layer.

15 Claims, 7 Drawing Sheets

(56) References Cited

U.S. PATENT DOCUMENTS

| | | | | |
|---|---|---|---|---|
| 2016/0091378 | A1* | 3/2016 | Tsai | G01L 19/0092 73/728 |
| 2017/0245036 | A1* | 8/2017 | Kuki | H04R 1/086 |
| 2019/0310155 | A1* | 10/2019 | Seo | H04M 1/18 |

FOREIGN PATENT DOCUMENTS

| | | | |
|---|---|---|---|
| JP | 4388603 | B2 | 12/2009 |
| JP | 2011-078089 | A | 4/2011 |
| JP | 2012-517184 | A | 7/2012 |
| JP | 2014 014266 | A | 1/2014 |
| JP | 2014-200024 | A | 10/2014 |
| JP | 2015-111816 | A | 6/2015 |
| JP | 2015-142282 | A | 8/2015 |
| WO | WO-2015/064028 | A1 | 5/2015 |

OTHER PUBLICATIONS

International Search Report arid Written Opinion from International Application No. PCT/US2017/026339 dated Jul. 4, 2017.

* cited by examiner

PRESSURE EQUALIZING CONSTRUCTION FOR NONPOROUS ACOUSTIC MEMBRANE

PRIORITY CLAIM

The present application is a national phase filing under 35 USC 371 of International Application No. PCT/US2017/026339, filed on Apr. 6, 2017, which claims the priority of U.S. Provisional App. No. 62/319,114, filed on Apr. 6, 2016, the entire contents and disclosures of which are hereby incorporated by reference.

TECHNICAL FIELD

The present disclosure relates generally to pressure equalizing constructions. More specifically, but not by way of limitation, this disclosure relates to a pressure-equalizing construction for protecting an acoustic device and equalizing pressure at the acoustic device.

BACKGROUND OF THE INVENTION

Acoustic cover technology is utilized in many applications and environments, for protecting sensitive components of acoustic devices from environmental conditions. Various components of an acoustic device operate best when not in contact with debris, water, or other contaminants from the external environment. In particular, acoustic transducers (e.g. microphones) may be sensitive to fouling. For these reasons, it is often necessary to enclose working parts of an acoustic device with an acoustic cover.

Known protective acoustic covers include non-porous films and porous membranes, such as expanded polytetrafluoroethylene (ePTFE). Protective acoustic covers are also described in U.S. Pat. Nos. 6,512,834 and 5,828,012. A protective cover can transmit sound in two ways: the first is by allowing sound waves to pass through it, known as a resistive protective cover; the second is by vibrating to create sound waves, known as a vibroacoustic, or reactive, protective cover.

Japanese Patent Application Publication No. 2015-142282 (P2015-142282A) discloses a waterproof component provided with a waterproof sound-transmittable film. A support layer is adhered to the surface of at least one side of the waterproof sound-transmittable film. The support layer polyolefin-system-resin foam, with a loss modulus of less than $1.0\times10^7$ Pa.

Japanese Patent Application Publication No. 2015-111816 (P2015-111816A) discloses a waterproof ventilation structure and a waterproof ventilation member.

WO2015/064028 discloses a waterproof ventilation structure. The structure includes a casing having an inner space and an opening section, a waterproof ventilation film which is disposed in a manner so as to block the opening section, an electro-acoustic conversion component which is disposed in the inner space, a first double-sided adhesive tape which directly bonds to the inner surface of the casing and to the peripheral edge section of a surface of the waterproof ventilation film, and a second double-sided adhesive tape which directly bonds to the peripheral edge section of the reverse surface of the waterproof ventilation film and to the component. The water pressure resistance of the waterproof ventilation film is 50 kPa or more, and the substrate of the first double-sided adhesive tape is a foam body.

U.S. Pat. No. 6,188,773 discloses a waterproof type microphone, which includes a mike casing provided with an unit accommodating chamber having a sound receiving opening portion, a mike unit accommodated in the unit accommodating chamber, and a waterproof membrane air tightly mounted on the sound receiving opening portion. The waterproof microphone further includes a venting hole formed in the mike casing to cause the unit accommodating chamber to be communicated with outside of the mike casing and a pressure equalizing membrane mounted on the venting hole.

U.S. Patent Application Publication No. 2014/0270273 discloses system and method for controlling and adjusting a low-frequency response of a MEMS microphone. The MEMS microphone includes a membrane and a plurality of air vents. The membrane is configured such that acoustic pressures acting on the membrane cause movement of the membrane. The air vents are positioned proximate to the membrane. Each air vent is configured to be selectively positioned in an open position or a closed position. A controller determines an integer number of air vents to be placed in the closed position, and generates a signal that causes the integer number of air vents to be placed in the closed position and causes any remaining air vents to be placed in the open position.

U.S. Patent Application Publication No. 2015/0163572 discloses a speaker or microphone module that includes an acoustic membrane and at least one pressure vent. The pressure vent equalizes barometric pressure on a first side of the acoustic membrane with barometric pressure on a second side of the acoustic membrane. Further, the pressure vent is located in an acoustic path of the speaker or microphone module. In this way, differences between barometric pressures on the different sides of the acoustic membrane may not hinder movement of the acoustic membrane. In one or more implementations, the pressure vent may be acoustically opaque. As the pressure vent is located in the acoustic path of the speaker or microphone module, being acoustically opaque may ensure that the pressure vent itself does not interfere with the operation of the speaker or microphone module.

A continuing problem that exists is that many acoustic cover designs prove unsuitable for some environments. For example, increasing the resiliency of a design against water penetration can decrease the ability of the design to equalize air pressure around the acoustic device, which may be caused by changes in temperature, ambient pressure, or other environmental changes. A pressure difference can affect or impede the acoustic response of the membrane in the acoustic cover and can lead to acoustic transducer bias.

BRIEF SUMMARY OF SOME EXAMPLE EMBODIMENTS

According to one embodiment of the present invention, a pressure equalizing assembly for an acoustic device is provided by a housing having an opening for passing acoustic waves between an exterior of the housing and an acoustic cavity therein. A nonporous membrane having a first side facing the acoustic cavity and a second side facing the opening is connected with the housing. A breathable layer connected with at least a portion of the first side of the nonporous membrane is configured to define the acoustic cavity. An acoustic device can be connected with the acoustic cavity, the acoustic device being capable of generating and/or receiving acoustic waves. The breathable layer can provide airflow into or out of the acoustic cavity of not greater than 500 mL/min at 6.9 kPa to equalize pressure between the acoustic cavity and an environment outside of the acoustic cavity.

In embodiments, components (or layers) of a pressure equalizing assembly can introduce a decrease in acoustic sensitivity of an acoustic device assembled with the pressure equalizing assembly caused by absorption or redirection of acoustic energy, herein described as insertion losses. Insertion losses may be measured as a decrease in acoustic pressure (e.g. in dB) as measured by an acoustic transducer in a pressure equalizing assembly compared to a similarly situated transducer without any nonporous membrane or breathable layer. Preferably, embodiments will produce minimal insertion losses (i.e. no insertion losses or minor insertion losses) over a range of frequencies (i.e., a small insertion loss that is consistent in amplitude across a range of frequencies). Some embodiments may produce insertion losses that peak in amplitude at one or more frequencies or frequency ranges. In some embodiments, a pressure equalizing assembly can have an insertion loss peak of not greater than 30 dB, not greater than 25 dB, not greater than 20 dB, not greater than 15 dB, not greater than 10 dB, or not greater than 5 dB. Various embodiments of a pressure equalizing assembly can provide, via the breathable layer, airflow into or out of the acoustic cavity not greater than 250 mL/min at 6.9 kPa, not greater than 100 mL/min at 6.9 kPa.

In some embodiments, a pressure equalizing assembly can provide airflow into or out of the acoustic cavity sufficiently high to prevent or rapidly eliminate a pressure buildup or pressure difference between the acoustic cavity and ambient. A pressure equalizing assembly can equalize pressure between the acoustic cavity and, e.g., an interior environment of a device housing that is outside the acoustic cavity. A pressure equalizing assembly can include a breathable layer that is configured to prevent moisture from entering the acoustic cavity.

In some embodiments, a pressure equalizing assembly can include an acoustic device comprising a micro-electric mechanical (MEMs) microphone, a transducer, an acoustic sensor, an acoustic speaker, a flex circuit having a MEMS acoustic transducer thereon, or like device.

In some embodiments, a pressure equalizing assembly can include a breathable layer bounding the acoustic cavity. In some cases, the breathable layer can comprise a ring about the acoustic cavity. The breathable layer can be a polymeric material, metallic material, ceramic material, composite material, textile material, or adhesive material capable of passing air therethrough. In some cases, the breathable layer has a positive, nonzero water entry pressure resistance, e.g. not less than 0.2 psi. In some cases, the breathable layer can include a porous ePTFE layer, a woven textile or woven textile composite.

In some embodiments, a pressure equalizing assembly can include a first adhesive layer between a first side of a nonporous membrane and at least a portion of a breathable layer. In some cases, a second adhesive layer may be attached between the breathable layer and the acoustic device. A third adhesive layer may attach between the nonporous membrane and an interior surface of a housing.

According to some embodiments of the present disclosure, a pressure equalizing assembly for an acoustic device is provided by an assembly of a nonporous membrane in an acoustic pathway having a first side and a second side, the first side facing toward an acoustic cavity and the second side of the nonporous membrane facing toward an opening of a housing. A layered assembly can define walls of the acoustic cavity, the layered assembly including a breathable layer, wherein a first side of the breathable layer is attached with at least a portion of the first side of the nonporous membrane, and a second side of the breathable layer is configured to attach with an acoustic device. The breathable layer can provide airflow into or out of the acoustic cavity of not greater than 500 mL/min at 6.9 kPa to equalize pressure between the acoustic cavity and an environment outside of the acoustic cavity.

In some embodiments, a pressure equalizing assembly includes a channel fluidly connecting the acoustic cavity with a portion of the breathable layer that partially defines a venting pathway, the venting path being laterally offset from an acoustic pathway. In some embodiments, an adhesive layer can be connected between the breathable layer and the acoustic device, and the channel may be present in the adhesive layer, e.g. as a void, groove, or other negative feature of the adhesive layer forming the channel. In some embodiments, a gasket may connect between the breathable layer and the acoustic device, and the channel may be present in the gasket.

In some embodiments, a layered assembly defines walls of the venting pathway, the breathable layer being disposed across the venting pathway such that air passing through the venting pathway passes through at least a portion of the breathable layer. In some embodiments, the venting pathway fluidly connects the acoustic cavity with an environment outside of the acoustic cavity, so as to equalize pressure between the acoustic cavity and the environment outside of the acoustic cavity. A housing may contain the nonporous membrane, layered assembly, and acoustic device, such that the acoustic pathway connects with an exterior of the housing through an opening in the housing; and the venting pathway connects the acoustic cavity with an interior environment of the housing.

These and other embodiments, along with many of their advantages and features, are described in more detail in conjunction with the below description and attached figures.

BRIEF DESCRIPTION OF THE DRAWINGS

The present invention will be better understood in view of the appended nonlimiting figures.

DETAILED DESCRIPTION

Figure 1:
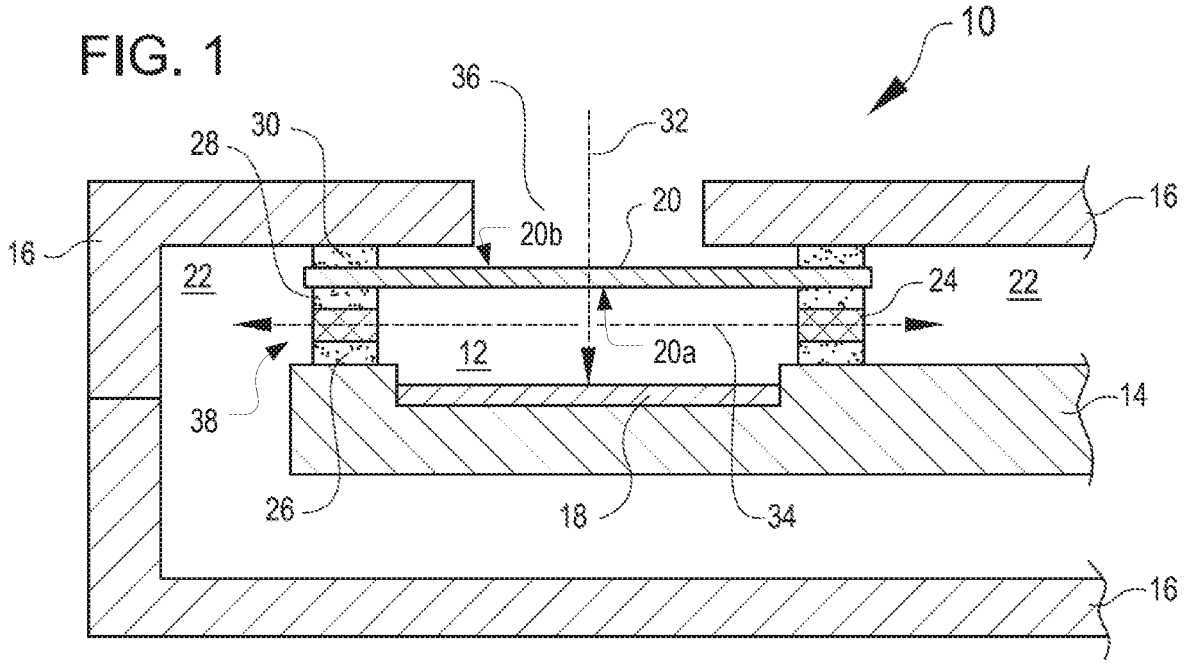
FIG. 1 shows a cross-sectional view of an acoustic device with a pressure equalizing assembly, in accordance with embodiments.

Various embodiments described herein address a pressure equalizing assembly for an acoustic device. The pressure equalizing assembly includes a nonporous membrane that provides protection from moisture and water infiltration, as well as a breathable layer that provides for pressure equalization by providing a venting pathway. In one embodiment, an acoustic cover comprises nonporous membrane for high immersion applications. Advantageously the nonporous membrane provides resistant to moisture and protects the acoustic device from potential damage from the exterior environment.

The breathable layer may be different from the nonporous membrane and provides for pressure equalization at the acoustic device without impairing the protection from water infiltration. A breathable layer can direct a venting pathway that does not directly encounter the external environment. For example, a venting pathway can exit the pressure equalizing assembly within a housing that contains the acoustic device, whereas the acoustic pathway is generally directed to an opening in the housing to the external environment. For this reason, a venting pathway does not necessarily need to be waterproof, and can be tuned to provide a desired rate of pressure transfer through the venting pathway. For example, the venting pathway can be at least partially defined by a breathable layer, through which pressure equalizes between a protected portion, or acoustic cavity, of the acoustic pathway and the environment on an opposite end of the venting pathway inside the housing.

Pressure Equalization

A venting pathway provides for pressure equalization between an acoustic cavity and an environment outside of the acoustic cavity, such as an interior environment of a housing containing an acoustic device. In particular, a venting pathway may be tuned to provide a particular venting rate or equilibration rate caused by a pressure difference across the venting pathway. Equilibration rate may be described with an exponential decay time constant T, which is defined as the time required for an assembly to equilibrate from an initial pressure value to a value of 1/e times the initial pressure value, or by approximately 63%. Equilibration rate may also be described with reference to a different second value, e.g. by 95% or 99%. In one embodiment, the equilibration rate across a venting pathway is tuned by selecting the material properties of a breathable layer forming the venting pathway, a surface area of the breathable layer, and/or a thickness of the breathable layer. Generally, a breathable layer with more area through which air can pass will have a faster equilibration rate than a thin breathable layer, and a material having a greater degree of porosity will translate to a faster equilibration rate than a material with relatively low porosity. In some cases, the breathability or equilibration rate of the breathable layer may be related to a structure of the breathable layer independent of the porosity, thickness, or surface area. For example, a breathable layer may include a channel or void through which air can vent. A nonporous material will typically have an immeasurably slow equilibration rate, but may pass air slowly via a diffusion mechanism.

In one embodiment, the equilibration rate may be tuned such that it is sufficiently high to allow for the pressure within the acoustic cavity to equilibrate in step with environmental changes. For example, a temperature change at the acoustic cavity may cause an expansion or contraction of air within the acoustic cavity, which would tend to increase or decrease the pressure of the air in the acoustic cavity. Pressure, whether above or below ambient pressure, in the acoustic cavity can impact the ability of a transducer to deflect relative to the way a transducer would deflect in free air. This effect may be particularly pronounced with MEMs transducers. Therefore, pressure changes in the acoustic cavity can cause transducer bias by altering the response of a transducer to sound waves. Increased or decreased pressure in an acoustic cavity relative to ambient pressure may lead to deformation or stress in the nonporous membrane, which can impede the acoustic response of the nonporous membrane and cause an increase in the apparent insertion loss caused by the nonporous membrane. The equilibration rate may be sufficiently high to allow air to enter or leave the acoustic cavity via the venting path quickly enough to substantially prevent or mitigate pressure buildup or loss leading to a significant pressure difference from ambient. Preventing or mitigating the pressure buildup or loss can mitigate or prevent transducer bias. Preventing or mitigating the pressure buildup or loss may also mitigate or prevent deformation in the nonporous membrane that could otherwise impede the acoustic response of the nonporous membrane.

In some embodiments, the equilibration rate may be tuned for an application with particular conditions. By way of a first nonlimiting example, for an acoustic device configured for use in shipping (e.g. for monitoring a shipping container), pressure may fluctuate on the order of 13.8 kPa (2 psi) over an 8 hour period. For such applications, a pressure equalizing assembly may only need to equilibrate at a rate of about 0.034 kPa/min (0.005 psi/min), with an exponential decay time constant T of about 9600. By way of a second nonlimiting example, for an acoustic device configured for use with passenger or cargo aircraft, pressure may fluctuate during takeoff on the order of 22.8 kPa (3.3 psi) over a 20 minute period. For such applications, a pressure equalizing assembly may need to equilibrate at a rate of about 1.14 kPa/min (0.165 psi/min), with an acoustic decay time constant T of about 400. By way of a third nonlimiting example, for an acoustic device for use with a fast and tall elevator, pressure may fluctuate on the order of about 7.6 kPa (1.1) psi over a 66 second period. For such applications, a pressure equalizing assembly may need to equilibrate even more quickly, e.g. on the order of 6.89 kPa/min (1 psi/min), with an acoustic decay time constant T of about 22. Other applications may require faster or slower equilibration rates. Specific breathable layers may be selected based on the application to achieve the desired equilibration rates while minimizing insertion losses.

In one embodiment, the equilibration rate may also be tuned such that it sufficiently low to mitigate acoustic insertion loss due to sound waves being absorbed and/or reflected by the venting pathway. In practice, any insertion in the acoustic path between the generator and the receiver may cause insertion losses (e.g. sound pressure loss in the non-porous membrane or walls of an acoustic cavity). It has been shown that highly breathable venting layers in an acoustic pathway result in one or more peaks of insertion loss across a frequency range. Thus, a breathable layer is preferably sufficiently breathable to allow for equilibration, but not so breathable that it causes excessive insertion loss or an insertion loss peak. Thus, in preferred embodiments, the equilibration rate is tuned to fall within a range that allows for equilibration in step with environmental changes (i.e. mitigating transducer bias or membrane response problems) while providing for sufficient acoustic opacity of the walls of the acoustic cavity (i.e. mitigating insertion losses or insertion loss peak).

Airflow into or out of the acoustic cavity may be correlated to the equilibration rate. A high airflow indicates a more breathable material, translating to pressure equalization rates sufficient to prevent transducer bias. A low airflow indicates a less breathable material, generally translating to reduced insertion loss peaks. Advantageously, the embodiments of the present invention provide airflow into or out of the acoustic cavity in an intermediate range that achieves adequate pressure equalization to mitigate transducer bias, but sufficiently low airflow to mitigate insertion loss peaks. In one embodiment, the breathable layer provides airflow into or out of the acoustic cavity of not greater than 500 mL/min at 6.9 kPa (1 psi), e.g., not greater than 250 mL/min, or not greater than 100 mL/min, to equalize pressure between the acoustic cavity and an environment outside of the acoustic cavity. While preventing transducer bias, the airflow may be maintained at such rates with an insertion loss or insertion loss peak of not greater than 30 dB, e.g., not greater than 15 dB, not greater than 10 dB, or not greater than 5 dB. The airflow through the breathable layer is sufficiently high to prevent a transducer bias. The airflow should be sufficient to allow pressure to balance between the acoustic cavity and an environment outside of the acoustic cavity so as to prevent or mitigate a pressure imbalance or pressure difference from ambient. In one embodiment, the airflow through the breathable layer and airflow into or out of the acoustic cavity is greater than 0 mL/min at 6.9 kPa (1 psi), while preferably being nonzero or close to zero. The airflow through the nonporous membrane is negligible.

In some specific examples, equilibration rates may be selected for particular applications. For example, a sensor for use in an application where the external pressure or temperature is expected to change rapidly might have increased breathability relative to a sensor for use in an application in which the external pressure or temperature changes more slowly.

Pressure Equalizing Assembly

FIG. 1 shows a cross-sectional view of a pressure equalizing assembly 10 for an acoustic device 14, in accordance with embodiments. The acoustic device 14 may be an electronic device for generating and/or receiving the acoustic waves. The acoustic device 14 is connected with the acoustic cavity 12 so that acoustic waves generated by acoustic device pass directly into the acoustic cavity 12 and so that acoustic waves received by the acoustic device are propagated directly from the acoustic cavity 12 to the acoustic device 14. For example, the acoustic device 14 can include a circuit having a transducer 18. In some embodiments, the transducer 18 can be a microphone or other acoustic sensor, a speaker, a pressure sensor, or other comparable type of sensor. In some embodiments, the transducer 18 may be a micro-electric mechanical (MEMs) device, such as a microphone, acoustic sensor or acoustic speaker. The acoustic device 14 may be an electronic circuit board, for example a flex circuit, containing the transducer 18 thereon. In some embodiments, the acoustic device 14 may be a sensing module or control circuit for a portable electronic device, such as a cellular phone, smartphone, tablet, portable microphone, handheld computing device or other comparable device.

The acoustic device 14 is at least partially encompassed by a housing 16, which protects the acoustic device 14 from an external environment, and may be at least partially sealed and/or waterproof. In some cases, the housing 16 may be a plastic or metal case. The housing 16 contains an interior environment 22 which at least partially surrounds the acoustic device 14.

An acoustic pathway 32 is partly defined by an opening 36 in the housing 16, in accordance with embodiments. Although a single opening is shown in FIG. 1, in other embodiments there may be a plurality of openings in the housing that collectively define an acoustic pathway or individual acoustic pathways. The opening 36 in housing 16 is for passing acoustic waves between an exterior of the housing 16 and an acoustic cavity 12 therein. In one embodiment, the acoustic pathway 32 is arranged to allow pressure waves, i.e. acoustic waves, to propagate from an exterior the housing 16 to the transducer 18 of the acoustic device 14 when detecting sound. Similarly in other embodiments, acoustic pathway 32 is arranged to allow pressure waves produced by the acoustic device 14 to propagate towards the exterior of the housing 16. The acoustic pathway 32 is traversed by a nonporous membrane 20, which further defines an acoustic cavity 12. Because the nonporous membrane 20 traversed the acoustic pathway 32 the nonporous membrane 20 may also be referred to herein as a nonporous acoustic membrane. The nonporous membrane 20 has a first side **20*a* facing the acoustic cavity 12 and a second opposing side 20*b* facing the opening 36. The acoustic cavity 12 is disposed between the nonporous membrane 20 and a portion of the acoustic device 14 including the transducer 18. To provide a sufficient acoustic cover, minimum diameter of the nonporous membrane 20 is at least equal to or greater than the maximum diameter of the opening 36. The maximum diameter of the opening 36 may vary depending on the application and construction of the housing. The pressure equalizing assembly of the present invention is suitable for any size of opening and is not particularly limited. In one exemplary embodiment, the diameter of the opening 36 is from 0.1 mm to 500 mm, e.g., 0.3 mm to 25 mm, e.g., 0.5 mm to 10 mm. Based on these exemplary diameters of the opening, the minimum diameter of the nonporous membrane is at least 0.1 mm, e.g., at least 0.3 mm, e.g., at least 0.5 mm. Having such a size relationship allows the nonporous membrane 20 to fully traverse the acoustic pathway 32 and prevent intrusion of fluid or moisture into the acoustic cavity 12. The interior environment 22 of the housing 16 is also at least partially sealed from intrusion of fluid or moisture from an exterior environment by the nonporous membrane 20**.

In some embodiments, a total thickness of the layered assembly 38 may be on the order of about 25 μm to about 2500 μm. In some cases, a total thickness of the layered assembly may be on the order of about 100 μm to less than 1000 μm. There are several applications of the acoustic device having various configurations. Without being limiting, in some exemplary applications an acoustic device may be used in combination with a MEMs transducer having comparably small thickness, e.g. on the order of 100 μm to 1000 μm. Thus, an acoustic device incorporating the layered assembly 38 may be very thin, on the order of 0.2 to 1.2 mm, which is suitable for inclusion in many small form factor applications, such as handheld electronic devices.

In one embodiment the nonporous membrane may be a layer of nonporous polymer composite. Various nonporous membrane materials may include polymer films (e.g. TPU, PET, Silicone, Polystyrene block copolymer, FEP, and the like) or polymer composites. Expanded polytetrafluoroethylene (ePTFE) composite structures provide a good balance of acoustics and water protection. Various nonporous materials have excellent acoustic transference and provide excellent water protection, in addition to being very thin and lightweight. For example, nonporous materials provide extra protection against low surface-tension fluids. In one embodiment the nonporous membrane may have thickness no greater than 500 μm, e.g., no greater than 200 μm, or no greater than 100 μm. In some embodiments, the nonporous membrane may have a thickness of no greater than 100 μm, no greater than 50 μm, or no greater than 20 μm. The nonporous membrane is sufficiently thick to resist bursting under pressures caused by fluctuating exterior pressure and/or fluctuating temperature within the acoustic cavity, while being sufficiently thin so as to minimally obstruct acoustic energy passing through the nonporous membrane. A nonporous membrane is sufficiently thick to resist excessive deformation of the membrane that would detrimentally impact acoustic performance.

The nonporous membrane 20 is connected with the acoustic device 14 and the housing 16 across the acoustic pathway 32, in accordance with the following embodiments. As described herein there is a breathable layer 24 connected with at least a portion of the first side 20*a* of the nonporous membrane 20. The breathable layer 24 also defines the acoustic cavity 12. The breathable layer 24 is not positioned in the acoustic pathway and provides for venting of the acoustic cavity 12. Due to the arrangement of the breathable layer 24 the venting is at least partially lateral to the acoustic pathway 32. For example, the nonporous membrane 20 can be connected with the acoustic device 14 by a layered assembly 38 comprising a first adhesive layer 26, a breathable layer 24, and a second adhesive layer 28. The layered assembly 38 defines the walls of the acoustic cavity 12. The nonporous membrane 20 can be further connected with the housing 16 opposite the acoustic device 14 by a third adhesive layer 30. The third adhesive layer 30 and the nonporous membrane 20 seal the housing 16 such that liquid does not intrude into the interior environment 22. The first and second adhesive layers 26, 28 and the breathable layer 24 provide a venting pathway 22 between the acoustic cavity 12 and the interior environment 22. The breathable layer 24 allows venting of air into and out of the acoustic cavity 12 at rates, e.g., not greater than 500 mL/min, that are sufficiently slow to mitigate or prevent insertion loss peaks from the acoustic cavity 12; but sufficiently rapid to allow for pressure to balance between the acoustic cavity 12 and an environment outside of the acoustic cavity so as to prevent or mitigate a pressure imbalance or pressure difference. For example, the breathable layer 24 may allow for pressure to balance between the acoustic cavity 12 and the interior environment 22.

The breathable layer 24 can be made of many materials, including: polymeric, composite, textile, metallic, or ceramic materials, as well as breathable adhesive or adhesive tape. The breathable layer 24 may also include a material having venting features, e.g. inherent porosity, surface features, and the like. For example, the breathable layer can be made of many polymeric materials including, polyamide, polyester, polyolefins such as polyethylene and polypropylene, or fluoropolymers. Fluoropolymers may be used for their inherent hydrophobicity, chemical inertness, temperature resistance, and processing characteristics. Exemplary fluoropolymers include polyvinylidene fluoride (PVDF), tetrafluoroethylene-hexafluoropropylene copolymer (FEP), tetrafluoroethylene-(perfluoroalkyl) vinyl ether copolymer (PFA), polytetrafluoroethylene (PTFE), and the like. Breathable layers, if not made of inherently hydrophobic materials, can have hydrophobic properties imparted to them, without significant loss of porosity, by treatment with fluorine-containing water- and oil-repellent materials known in the art. For example, the water- and oil repellent materials and methods disclosed in U.S. Pat. Nos. 5,116,650; 5,286,279; 5,342,434; 5,376,441; and other patents, can be used. Textile breathable layers may comprise a woven, non-woven, and knitted material. In one embodiment, the textile breathable layer can comprise breathable textile materials or textile/polymer composite materials. Exemplary breathable layers include Gore® ePTFE part #AM1XX, Milliken® (170357) woven textile, Ahlstrom Hollytex® (3254) non-woven textile, Saatifil Acoustex® (160) woven textile, Saatifil Acoustex® (90) woven textile, and Precision Fabrics® (B6700) non-woven textile. In one embodiment, breathable layers have a nonzero, positive water entry pressure resistance so as to provide secondary protection against moisture/water intrusion.

Specific breathable layers may have a wide range of pore sizes, pore volumes, water entry pressures, through plane air permeability, lateral permeability, and other material and/or part properties. For comparative purposes, a porous ePTFE breathable layer may have a thickness in the range of about 10 to 1000 micrometers, e.g., approximately 180 micrometers.

Figure 2:
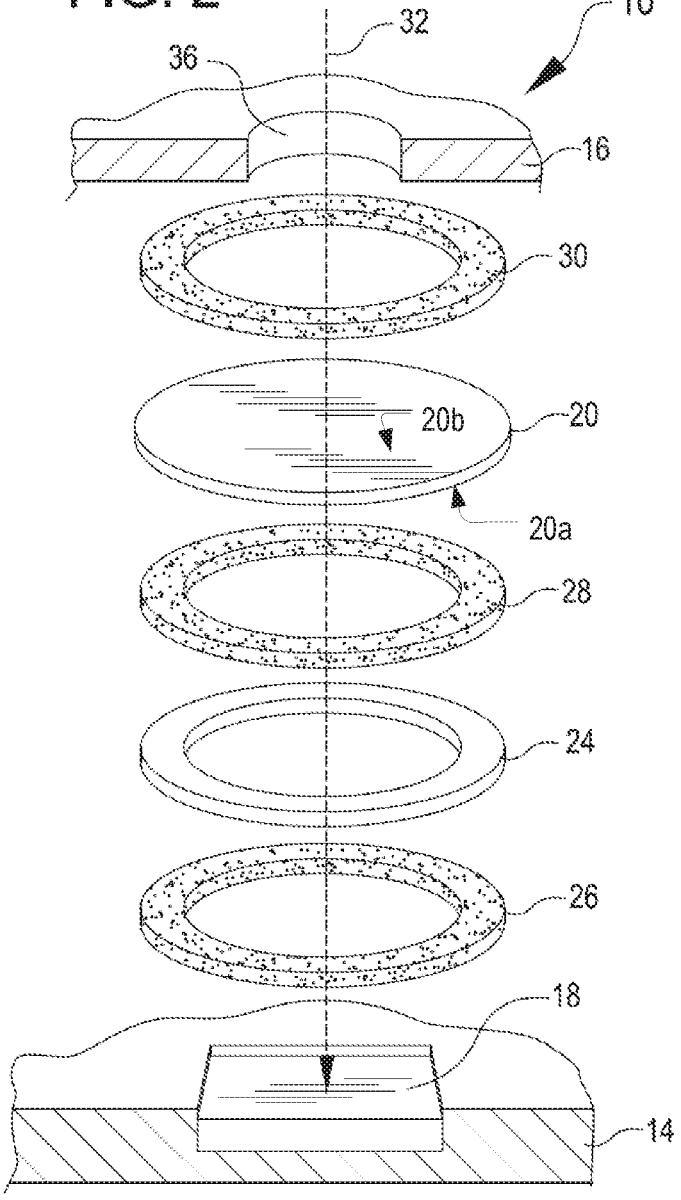
FIG. 2 shows an exploded perspective view of a pressure equalizing assembly, like the assembly of FIG. 1, arranged on an acoustic device, in accordance with embodiments.

FIG. 2 shows a simplified assembly view of the pressure equalizing assembly 10 shown in FIG. 1, in accordance with embodiments. The pressure equalizing assembly 10 is arranged to form the acoustic pathway 32 for sound waves to propagate from outside the case 16 to the transducer 18 of the audio device 14, or vice versa. Individual components of the pressure equalizing assembly 10 can have varying shapes, widths, or thicknesses. In the exemplary assembly shown 10, the adhesive layers 26, 28, 30, and the breathable layer 24 take a hollow elliptical or circular shape, but other hollow shapes are possible within the scope of this disclosure. The breathable layer 24 may be a ring that is positioned along the perimeter of the nonporous membrane 20 so that breathable layer 24 is not in the acoustic pathway. The nonporous membrane 20 takes on a solid circular or elliptical shape that matches the shapes of the above layers, but likewise, other shapes are possible. Individual components of the assembly 10 may be repeated in order to vary the functional characteristics of the assembly. For example, the first and second adhesive layers 26, 28 can be thickened or include a spacing layer (not shown) for increasing a volume of the acoustic cavity 12. An acoustic cavity of greater volume will tend to change in pressure more slowly than an acoustic cavity of smaller volume. The thickness of the breathable layer 24 (i.e., thickness in the direction of the acoustic pathway 32) may be targeted to a rate of venting air through the layer, respectively. In one embodiment, thickness of the breathable layer 24 is from 1 μm to 2000 μm, e.g., from 10 μm to 1000 μm or from 50 μm to 500 μm. Likewise, the width of the breathable layer 24 (i.e. the width perpendicular to the acoustic pathway 32) may vary depending on the application. As the width is increased, the rate of venting may be decreased, and vice versa. In one embodiment, width of the breathable layer 24 is from 0.1 mm to 250 mm, e.g., from 0.2 mm to 25 mm, or from 0.5 mm to 5 mm. In various embodiments, some subset of the above-described layers, e.g. the adhesive layers 26, 28, 30, may be replaced with other connection means.

Adhesive layers, such as the adhesive layers 26, 28, 30, can be formed of any suitable layer having an adhesive surface on each side for connecting two parts. For example, an adhesive layer can be a polymer layer impregnated with an adhesive surface treatment, similar to a two-sided plastic tape. Adhesive layers may include a double-sided self-adhesive tape comprising a PET backing and a tackified acrylic adhesive (e.g. TESA® 4972). Adhesive layers can have varying thicknesses according to a desired thickness of a pressure equalizing assembly. Exemplary adhesive layers may be any suitable thickness on the order of 5 to 1000 μm. Specific examples of adhesive layers are about 30 μm thick, or about 48 μm thick. Generally, an adhesive layer is waterproof and nonporous. However, in some cases, only an adhesive layer adjacent to an external environment may need to be waterproof.

Figure 3:
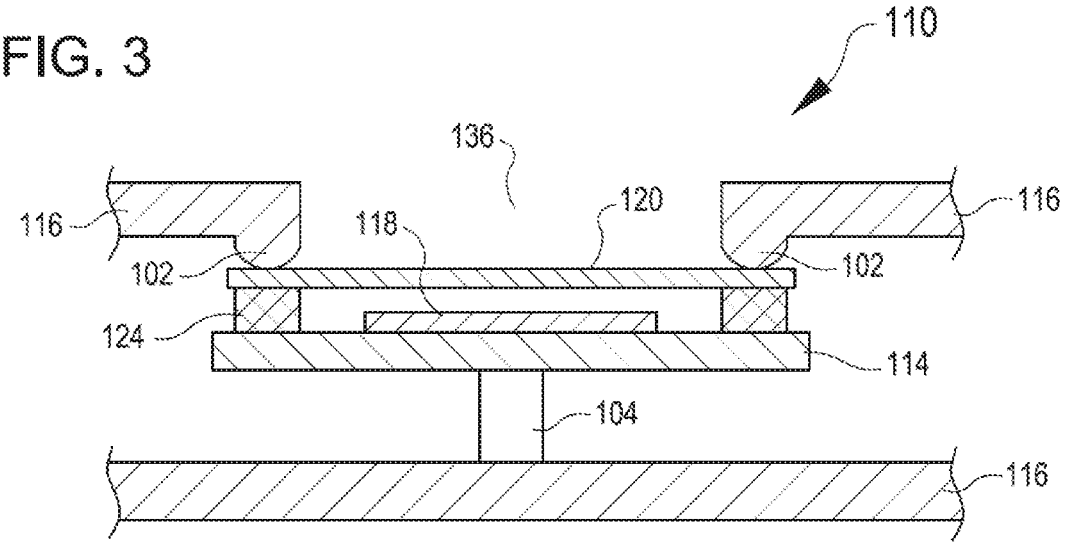
FIG. 3 shows a cross-sectional view of an acoustic device with an alternative embodiment of a pressure equalizing assembly.

FIG. 3 shows a side section view of another pressure equalizing assembly 110 without adhesive layers, in accordance with embodiments. In the pressure equalizing assembly 110, an acoustic device 114 is contained in a housing 116. The acoustic device 114 includes a transducer 118. The transducer 118 is bounded by the acoustic device 114, a nonporous membrane 120, and a breathable layer 124. The housing 116 is biased against, or contacts, the nonporous membrane 120. The nonporous membrane 120 is biased against or contacts the breathable layer 124 that further contacts the acoustic device 114 around the transducer 118. In some cases, the housing 116 can include an inward projection 102 for biasing the housing against the nonporous membrane 120. The pressure equalizing assembly 110 can also include a brace 104 that presses on the acoustic device 114 for holding the acoustic device tightly against the case 116 in order to form a seal by the nonporous membrane. Although one brace is shown in FIG. 3, in other embodiments, there may be a plurality of braces.

Figure 4:
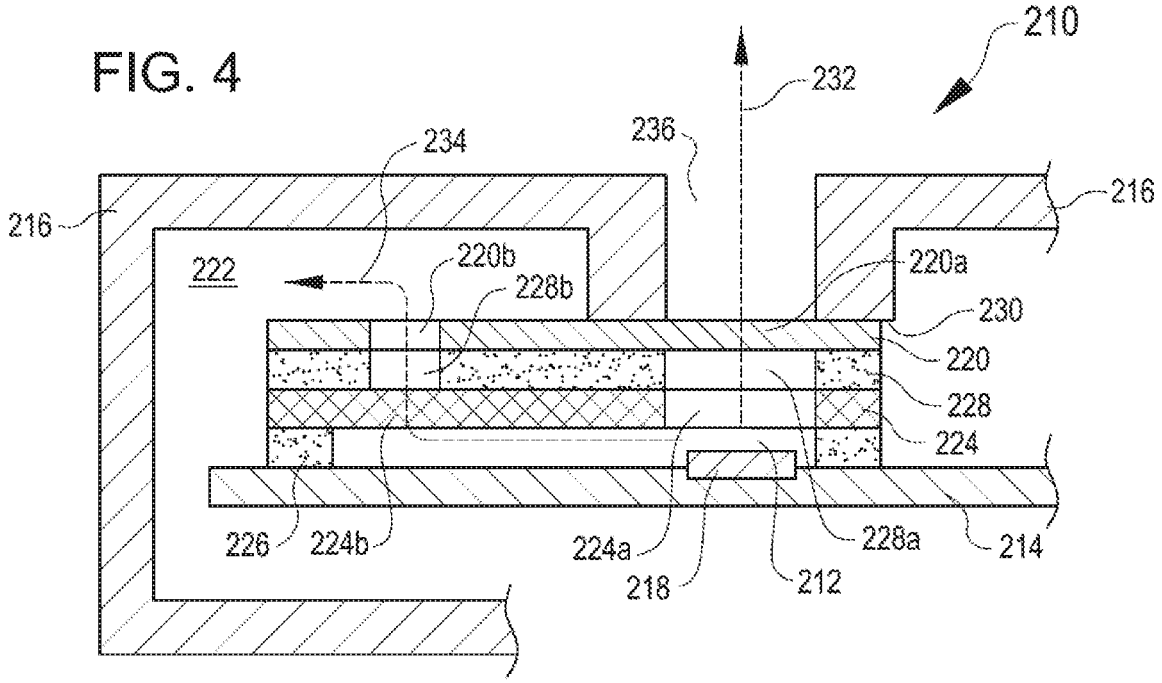
FIG. 4 shows a cross-sectional view of an acoustic device with a second alternative embodiment of a pressure equalizing assembly.

FIG. 4 shows a side section view of another pressure equalizing assembly 210 with an alternative venting pathway 232, in accordance with embodiments. An acoustic device 214 having a transducer 218 mounted thereon is arranged to detect (and/or transmit) acoustic waves via an acoustic pathway 232. The acoustic pathway 232 is aligned with the pressure transducer 218 and with an opening 236 in a housing 216 that at least partly surrounds the acoustic device 214. A portion of the acoustic pathway 232 adjacent to the transducer 218 defines an acoustic cavity 212. A venting pathway 234 is offset from the acoustic pathway 232 and configured for allowing pressure to equalize between the acoustic cavity 212 and an interior portion 222 of the housing 216.

A breathable layer 224 is arranged above the transducer 218. The breathable layer 224 has a first void 224*a* aligned with the acoustic pathway 232. The first void 224*a* in the breathable layer 224 facilitates the transfer of acoustic waves along the acoustic pathway 232. The venting pathway 234 passes through a closed portion 224*b* of the breathable layer 224 offset from the acoustic pathway 232. As used herein offset refers to the venting pathway 234 being not aligned within the acoustic pathway 232 through the non-porous membrane. A spacing layer 228 is arranged abutting the breathable layer 224 opposite the transducer 218. The spacing layer 228 may be connected with the breathable layer 224 by, e.g., an adhesive, by mechanical pressure, or comparable means. The spacing layer 228 has a first void 228*a* aligned with the acoustic pathway 232 and a second void 228*b* aligned with the venting pathway 234. The second void 228*b* of the spacing layer 228 is sized to facilitate a desired pressure venting rate through the portion of the breathable layer 224 that aligns with the second void. A non-porous membrane layer 220 is arranged abutting the spacing layer 228 opposite the breathable layer 224. The non-porous membrane layer 220 can be connected with the spacing layer 228 by, e.g. adhesive, mechanical pressure, or the like. The non-porous membrane layer 220 traverses the acoustic pathway 232 over the first void 228*a* of the spacing layer 228, such that at least a portion of the non-porous membrane layer 220 forms an acoustic membrane 220*a* in the acoustic pathway 232. The non-porous membrane layer 220 has a void 220*b* further defining the venting pathway 234, the void 220*b* being aligned with the second void 228*b* of the spacing layer 228. The acoustic pathway 232 can be fluidly connected with the venting pathway 234 near the acoustic device 214. For example, a spacer 226 can fluidly connect the acoustic pathway 232 with the venting pathway 234. The acoustic pathway 232 may be fluidly connected with the venting pathway 234 by any other suitable means, such as a negative surface feature (e.g. groove or pathway) in the acoustic device 214, a negative surface feature in the breathable layer 224, a gasket or adhesive layer between the acoustic device 214 and the breathable layer 224, or similar means.

The non-porous membrane layer 220 connects with an opening 236 in the housing 216 such that the opening further defines the acoustic pathway 232. The non-porous membrane layer 220 may be adhered or otherwise sealed, e.g. with an adhesive coating, O-ring, gasket, or similar sealing means, to the opening 236 of the housing 216. In some cases, the non-porous membrane layer 220 may be pressed against the opening 236 of the housing 216 with mechanical force to form a seal. For example, the non-porous membrane layer 220 may abut an inward projection 230 of the casing 216. The non-porous membrane layer 220 can also connect the venting pathway 234 with, e.g., an interior portion 222 of the housing 216. Various additional layers may be used in conjunction with the layers described above for providing different functional characteristics. For example, additional spacing layers may be used to increase a volume of the acoustic cavity 212 or to space the nonporous membrane layer 220 further away from the opening 236.

The present invention will be better understood in view of the following nonlimiting examples and test results.

Test Results

Pressure Equilibration Test

Microphone cavity pressure equilibration is a test method for measuring the time it takes to equilibrate a pressure difference built up between a simulated acoustic cavity and the environment. A pressure vessel is pressurized through the pressure inlet and contains two Freescale Semiconductor MPX4250A pressure transducers. The simulated acoustic cavity (microphone cavity) is created at the interface of the acoustic pressure equalizing assembly and a pressure transducer, the pressure equalizing assembly comprising a non-porous membrane and a breathable layer. The pressure equalizing assembly is attached to the pressure transducer at ambient pressure before being put in the pressure vessel. The pressure transducer with the attached pressure equalizing assembly measures the pressure in the simulated microphone cavity while the other pressure transducer measures the pressure of the environment in the pressure vessel. The pressure vessel is pressurized to 27.6 kPa (4 psi) using compressed air and a regulator. The pressures measured by the pressure transducers are recorded until the pressures are equal or until a pre-defined amount of time has passed. The data for pressure differential over time between the two transducers can then be described by parameters such as the exponential decay time constant, $\tau$, which can be used as a measure of material performance. $3\tau$ corresponds to time for 95% of initial pressure to be equilibrated. A higher $\tau$ corresponds to slower equilibration and lower breathability.

Insertion Loss Detection Test

Insertion loss peaks can be detected by connecting each pressure equalizing assembly with an orifice of a steel plate, fully encasing the assembly within a support piece, and measuring sound generated by a speaker after passing through the orifice and the assembly. A Knowles® SPU0410LR5H MEMS measurement microphone is pressed against the backside of each sample assembly, and held in place using a foam piece with shore "0" hardness of 18 embedded in the support piece. The support piece is held fully in contact with the steel plate via ⅛th inch cylindrical N42 grade NdFeB magnets embedded in the support piece. Each total sample assembly is placed within a Brüel & Kjær® 4232 anechoic box at a distance of 6.5 cm from an internal driver or speaker. The speaker performs a frequency sweep at 88 dB sound pressure level over a frequency range from 100 Hz to 11.8 kHz. The measurement microphones measure the acoustic response as a sound pressure level in dB over the frequency range. In general, the assemblies with breathable layers exhibit consistently minor drops in sound pressure level across the frequency range. Insertion loss peaks were identified based on the presence of significant drops in sound pressure level at any frequency or range of frequencies.

ATEQ Airflow

ATEQ Airflow is a test method for measuring laminar volumetric flow rates of air through pressure equalizing assembly samples. The sample assembly (fixture and sample placement) used in the Insertion Loss Detection test method is also used for the ATEQ Airflow test, except the part is reversed so that the breathable layer faces the opening in the steel plate instead of the acoustic device. The sample assembly is clamped between two plates in a manner that only applies compression to the steel plate and seals against the top surface of the steel plate using an O-ring. An ATEQ Premier D Compact Flow Tester is used to measure airflow rate (mL/min) through the acoustic cover by challenging it with 6.9 kPa (1 psi) of air pressure through the orifice in the steel plate.

Example 1

Assemblies similar to the arrangement of FIG. 1 were assembled to assess the venting rate of various additional breathable layer materials, as detailed below in Table 1. In airflow tests, the sample assemblies were reversed and clamped against an orifice of a steel plate, such that air could be passed through the orifice into the acoustic cavity. An ATEQ® Premier D Compact Flow Tester was used to measure airflow rate (mL/min) out of the acoustic cavity (i.e. through the breathable layers) by challenging it with 1 psi of air pressure through the orifice in the steel plate.

In pressure equilibration tests, each sample assembly was connected with a simulated microphone cavity containing a first pressure transducer, and attached (sealed) to the simulated microphone cavity at ambient pressure. The simulated microphone cavities and sample assemblies were inserted into a pressure vessel, along with second pressure transducers outside the simulated microphone cavities. The pressure vessel was pressurized to 4 psi using compressed air and a regulator. The pressures recorded by each first and second pressure transducer were recorded over time until the pressures were equal or until a predefined amount of time had passed. The data for pressure equilibration over time may be expressed, for example, by parameters like the exponential decay time constant T, which is defined as the time required for an assembly to equilibrate from an initial pressure value to a value of 1/e times the initial pressure value (or approximately 63%).

Insertion loss peaks were detected using the techniques described above with respect to the insertion loss detection test.

Example A

An acoustic protective cover assembly was constructed using five layers. The first layer was a ring of double-sided self-adhesive tape consisting of a PET backing and a tackified acrylic adhesive (TESA® 4972, 48 μm thick). The second layer was stacked on top of the first layer. The second layer was a continuous non-porous polymeric film. The third layer was stacked on top of the first and second layers. The third layer was a ring of double-sided self-adhesive tape consisting of a PET backing and a tackified acrylic adhesive (TESA® 4983, 30 μm thick). The fourth layer was stacked on top of the first three layers. The fourth layer was a ring of woven material (Milliken & Company, Part number 170357). The fifth layer was stacked on top of the first four layers. The fifth layer was a ring of double-sided self-adhesive tape consisting of a PET backing and a tackified acrylic adhesive (TESA® 4983, 30 μm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by 3.24 second exponential time constant. This sample also had an acceptable airflow rate of 21 mL/min and an acoustic response without the presence of an insertion loss peak.

Example B

An acoustic protective cover was constructed of five layers as described in Example A. However, layer four of the sample was a polyester non-woven material (Hollytex®, Ahlstrom Corporation, Grade: 3254, 0.102 mm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by a 3.06 second exponential time constant. This sample also had an acceptable airflow rate of 22 mL/min and an acoustic response without the presence of an insertion loss peak.

Example C

An acoustic protective cover was constructed of five layers as described in Example A. However, layer four of the sample was a polyester woven material with an air resistance of 160 Rayls (Saatifil Acoustex®, SaatiTech, a division of Saati Group, Inc., Item name: Acoustex 160, 0.06 mm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by a 1.21 second exponential time constant. This sample also had an acceptable airflow rate of 13 mL/min and an acoustic response without the presence of an insertion loss peak.

Example D

An acoustic protective cover was constructed of five layers as described in Example A. However, layer four of the sample was a Gore ePTFE material (Gore® ePTFE part #AM1XX, W.L. Gore & Associates, Inc., 190 g/m$^2$, 0.185 mm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by a 100.7 second exponential time constant. The airflow test was not sensitive enough to measure airflow, and the acoustic response did not show an insertion loss peak.

COMPARATIVE EXAMPLES

Example W

An acoustic protective cover assembly was constructed using three layers. The first layer was a ring of double-sided self-adhesive tape consisting of a PET backing and a tackified acrylic adhesive (TESA® 4972, 48 μm thick). The second layer was stacked on top of the first layer. The second layer was a continuous non-porous polymeric film. The third layer was stacked on top of the first and second layers. The third layer was a ring of double-sided self-adhesive tape consisting of a PET backing and a tackified acrylic adhesive (TESA® 4972, 48 μm thick). This assembly was tested for pressure equilibration, ATEQ airflow, and acoustic insertion loss. This sample had an inadequate pressure equilibration time as evidenced by the 75,758 second exponential time constant. This sample had an airflow rate of 1 mL/min (test error/poor seal) and an acoustic response without the presence of an insertion loss peak.

Example X

An acoustic protective cover was constructed of five layers as described in Example A. However, layer four of the sample was a polyester woven material with an air resistance of 90 Rayls (Saatifil Acoustex®, SaatiTech, a division of Saati Group, Inc., Item name: Acoustex 90, 0.12 mm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by a 0.28 second exponential time constant. This sample also had an airflow rate of 363 mL/min and showed an insertion loss peak in the acoustic response.

Example Y-1

An acoustic protective cover assembly was constructed using four layers. The first layer was a ring of double-sided self-adhesive tape consisting of a PET backing and a silicone adhesive (Avery Dennison Corporation, 140 μm thick). The second layer was stacked on top of the first layer. The second layer was a commercially available non-porous FEP film. The third layer was stacked on top of the first and second layers. The third layer was a ring of double-sided self-adhesive tape consisting of a PET backing and a silicone adhesive (Avery Dennison Corporation, 140 μm thick). The fourth layer was stacked on top of the first three layers. The fourth layer was a ring of woven material (Precision Fabrics Group, Inc., Part number: B6700). This assembly was tested for pressure equilibration, ATEQ airflow, and acoustic insertion loss. This sample had an adequate pressure equilibration time as evidenced by the 1.04 second exponential time constant. This sample had an airflow rate of 677 mL/min and showed an insertion loss peak in the acoustic response.

Example Y-2

An acoustic protective cover assembly was constructed using four layers. The first layer was a ring of double-sided self-adhesive tape consisting of a PET backing and a tackified acrylic adhesive (TESA® 4972, 48 μm thick). The second layer was stacked on top of the first layer. The second layer was a continuous non-porous polymeric film. The third layer was stacked on top of the first and second layers. The third layer was a ring of double-sided self-adhesive tape consisting of a PET backing and a tackified acrylic adhesive (TESA® 4983, 30 μm thick). The fourth layer was stacked on top of the first three layers. The fourth layer was a ring of woven material (Milliken & Company, Part number 170357). This assembly was tested for pressure equilibration, ATEQ airflow, and acoustic insertion loss. This sample had an adequate pressure equilibration time as evidenced by the 0.39 second exponential time constant. This sample had an airflow rate of 2377 mL/min and showed an insertion loss peak in the acoustic response.

Example Z

An acoustic protective cover was constructed of five layers as described in Example 1. However, layer four of the sample was a polyester open cell foam (Foamex®, FXI, Inc., 90 pores per inch, 0.635 mm thick). This assembly was tested for pressure equilibration, ATEQ airflow, and acoustic insertion loss. The orientation of the sample was such that the fourth layer was closest to the pressure transducer, air pressure source, or microphone respectively. This sample had an adequate pressure equilibration time as evidenced by the very small (less than 0.5 second) exponential time constant. This sample had an airflow rate of 1190 mL/min and showed an insertion loss peak in the acoustic response.

Figure 5:
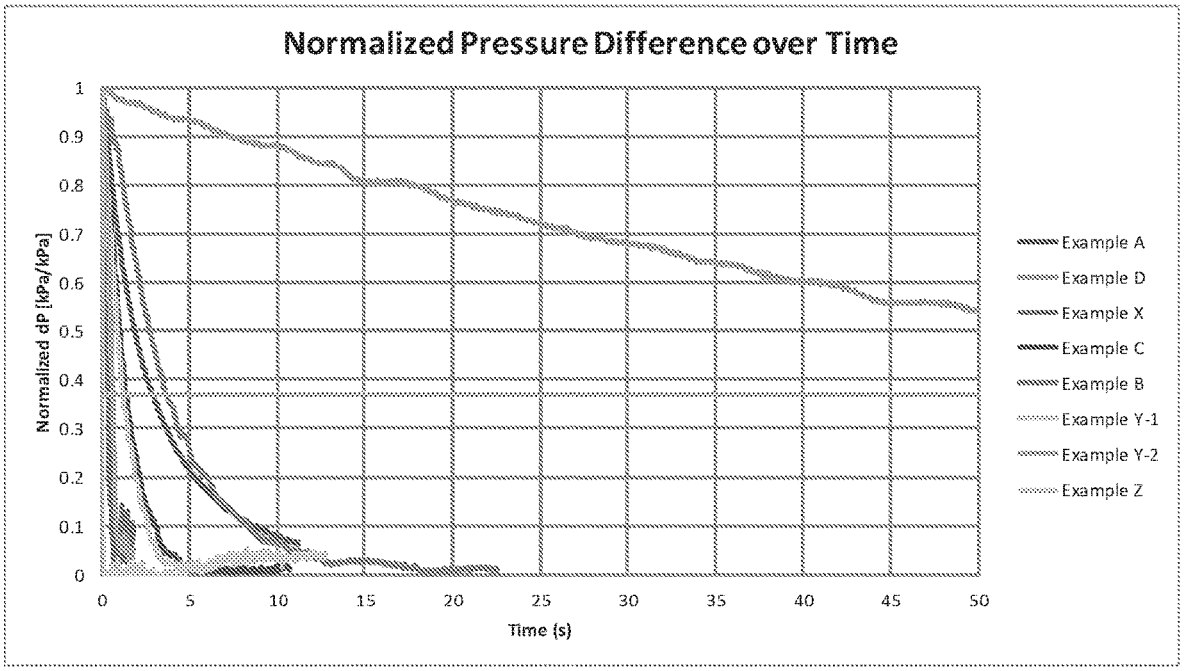
FIG. 5 shows an example chart showing pressure differences over time between an acoustic cavity and an environment outside the acoustic cavity with various embodiments of a pressure equalizing assembly.
Figure 6:
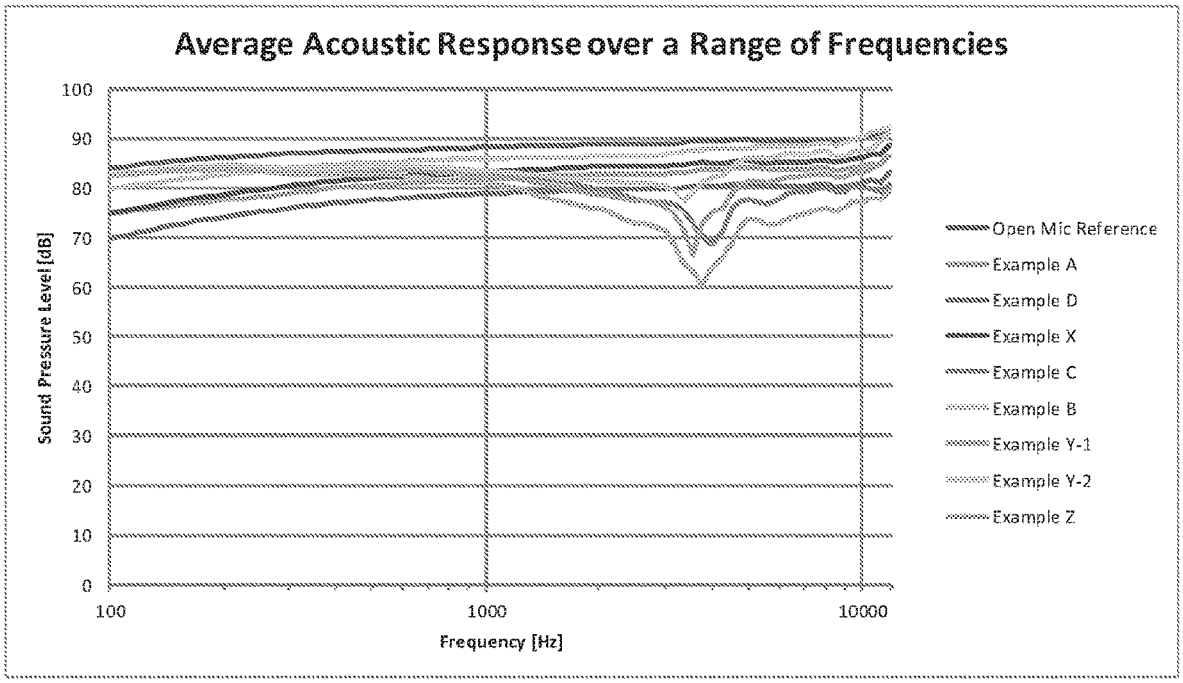
FIG. 6 shows an example chart showing acoustic amplitude (i.e. sound pressure levels in dB) at different frequencies for various embodiments of a pressure equalizing assembly.
Figure 7:
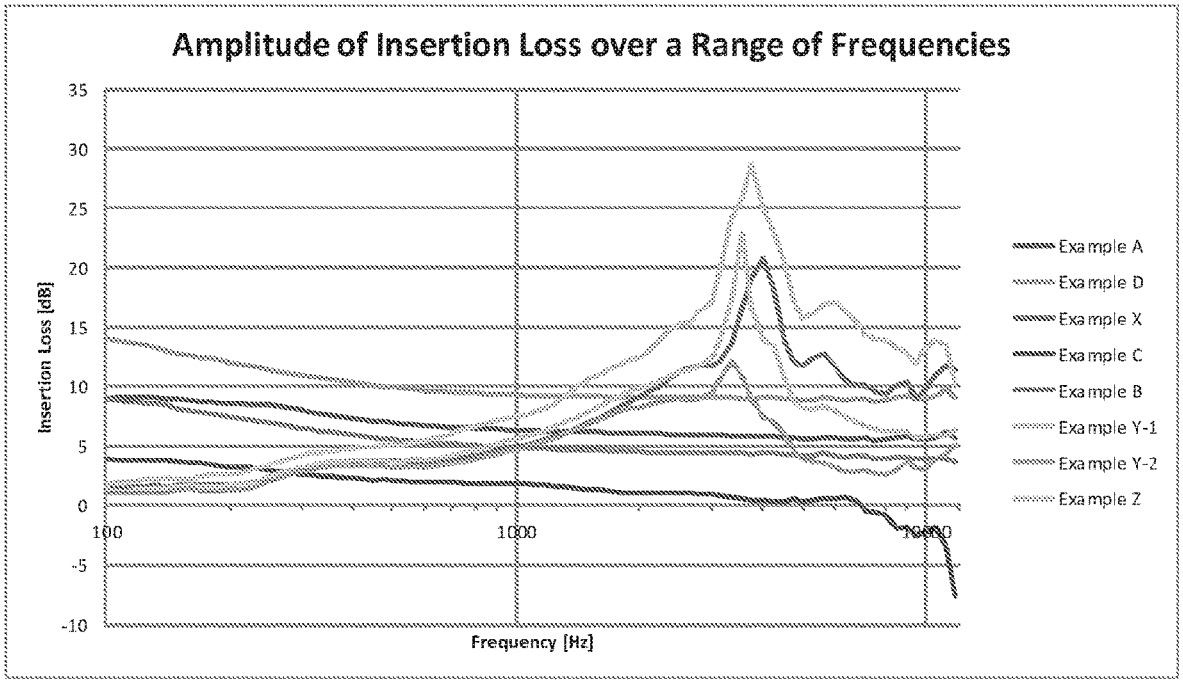
FIG. 7 shows an example chart showing insertion loss (i.e. difference in sound pressure level compared to an unobstructed microphone) at different frequencies for various embodiments of a pressure equalizing assembly.

The results of these breathable layers along with a comparative with no nonporous membrane or breathable layer (open hole control) are detailed below in Table 1. FIGS. 5-7 show example charts showing pressure equalization and acoustic properties of the various example assemblies.

FIG. 5 illustrates the pressure difference curves over time for average dP values of multiple tests for each of the above-referenced example assemblies. The control did not perceptibly decrease in dP over the test period. Each of the breathable assemblies having a porous membrane decreased in dP over the test period. Because equilibration is asymptotic, effective equilibration time was determined as an average time for 63% pressure equilibration to occur, as shown below with reference to Table 1. These values can be multiplied by 3 to show 95% equilibration or by 4.6 to show 99% equilibration if necessary.

FIG. 6 illustrates the acoustic response of the different test assemblies described above and with reference to FIG. 5. For purposes of comparison to an ideal case, an "open mic" or uncovered transducer was tested for frequency response. Then, for each assembly, the layered assembly was adhered to a front plate and a MEMS test transducer was connected to the layered assembly. The initial frequency response of the assembly was tested for each test assembly.

FIG. 7 illustrates the amplitude of insertion loss of the different test assemblies described above and with reference to FIGS. 5 and 6. Insertion loss is determined based on the difference between the frequency responses of each test case and an ideal case, i.e. an "open mic" control that has no nonporous layer or breathable layer.

TABLE 1

Compiled Test Results for Breathable Materials

| | Sample Breathable Layer | Breathable Material Type | Avg. flow rate @ 6.9 kPa (mL/min) | Avg. time to 63% pressure equilibration (s) | Insertion loss peaks |
|---|---|---|---|---|---|
| | | Inventive | | | |
| A | Milliken ® 170357 | Woven Textile | 21 | 3.24 | No |
| B | Ahlstrom Hollytex ® 3254 | Non-Woven Textile | 22 | 3.06 | No |
| C | Saatifil Acoustex ® 160 | Woven Textile | 13 | 1.21 | No |
| D | Gore ® ePTFE part #AM1XX | ePTFE | >0 | 100.7 | No |
| | | Comparative | | | |
| W | Non-Porous Control | n/a | 1 | 75758 | No |
| X | Saatifil Acoustex ® 90 | Woven Textile | 363 | 0.28 | Yes |
| Y-1 | Precision Fabrics ® B6700 (silicone Adhesive) | Non-Woven Textile | 677 | 1.04 | Yes |
| Y-2 | Precision Fabrics ® B6700 (acrylic Adhesive) | Non-Woven Textile | 2377 | 0.39 | Yes |
| Z | Foamex ® 90 ppi 1/40" | Open Cell Foam | 1190 | 0 | Yes |
| _ | Open Hole Control | n/a | 3507 | 0 | n/a |

Table 1, above, reflects test data for the average flow rates through a breathable layer when subjected with a pressure difference of 1 psi between an acoustic cavity and an environment outside the acoustic cavity, and average pressure equilibration times, for an induced pressure difference of 4 psi ramped up over one second between an acoustic cavity and an environment outside the acoustic cavity. As reflected above, in general, an increased flow rate corresponds to a more rapid pressure equilibration. A control lacking a breathable layer vented more slowly than the breathable tests by several orders of magnitude, which may be accounted for by diffusion across the nonporous membrane, through an adhesive layer, or through a minor fault. A control with an open hole rather than a breathable layer vented more quickly than pressure could be added to the acoustic cavity. In general, samples having breathable materials with large (e.g. 363 mL/min and greater) average flow rate exhibited significant insertion loss peaks, and samples with lower average flow rates did not.

The invention has now been described in detail for the purposes of clarity and understanding. However, those skilled in the art will appreciate that certain changes and modifications may be practiced within the scope of the appended claims.

In the preceding description, for the purposes of explanation, numerous details have been set forth in order to provide an understanding of various embodiments of the present invention. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present invention. Accordingly, the above description should not be taken as limiting the scope of the present invention or claims.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the present invention, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Also, the words "comprise," "comprising," "contains," "containing," "include," "including," and "includes," when used in this specification and in the following claims, are intended to specify the presence of stated features, integers, components, or steps, but they do not preclude the presence or addition of one or more other features, integers, components, steps, acts, or groups.

In the following, further examples are described to facilitate the understanding of the disclosure:

E1. A pressure equalizing assembly for an acoustic device, comprising a housing having an opening for passing acoustic waves between an exterior of the housing and an acoustic cavity therein, a nonporous membrane having a first side facing the acoustic cavity and a second side facing the opening, the nonporous membrane being connected with the housing, a breathable layer connected with at least a portion of the first side of the nonporous membrane and configured to define the acoustic cavity, and an acoustic device connected with the acoustic cavity, the acoustic device being capable of generating and/or receiving the acoustic waves, wherein the breathable layer provides an airflow into or out of the acoustic cavity of not greater than 500 mL/min at 6.9 kPa to equalize pressure between the acoustic cavity and an environment outside of the acoustic cavity.

E2. The assembly of any of the preceding or subsequent examples, having an insertion loss peak of not greater than 30 dB.

E3. The assembly of any of the preceding or subsequent examples, wherein the airflow into or out of the acoustic cavity is not greater than 250 mL/min at 6.9 kPa.

E4. The assembly of the preceding example, having an insertion loss peak of not greater than 30 dB.

E5. The assembly of any of the preceding or subsequent examples, wherein the airflow into or out of the acoustic cavity is not greater than 100 mL/min at 6.9 kPa.

E6. The assembly of the preceding example, having an insertion loss peak of not greater than 30 dB.

E7. The assembly of any of the preceding or subsequent examples, wherein the airflow into or out of the acoustic cavity is sufficiently high to prevent transducer bias.

E8. The assembly of any of the preceding or subsequent examples, wherein the airflow into or out of the acoustic cavity is sufficiently high to prevent a pressure difference that could otherwise impede an acoustic response of the nonporous membrane.

E9. The assembly of any of the preceding or subsequent examples, wherein the airflow into or out of the acoustic cavity is sufficient to prevent transducer bias.

E10. The assembly of any of the preceding or subsequent examples, wherein the airflow into or out of the acoustic cavity is sufficient to prevent a pressure difference that could otherwise impede an acoustic response of the nonporous membrane.

E11. The assembly of any of the preceding or subsequent examples, wherein the environment outside of the acoustic cavity comprises an interior environment of the housing.

E12. The assembly of any of the preceding or subsequent examples, wherein the nonporous membrane is configured to prevent moisture from entering the acoustic cavity.

E13. The assembly of any of the preceding or subsequent examples, wherein the acoustic device comprises a microelectric mechanical (MEMs) microphone.

E14. The assembly of any of the preceding or subsequent examples, wherein the acoustic device comprises a transducer.

E15. The assembly of any of the preceding or subsequent examples, wherein the acoustic device comprises an acoustic sensor.

E16. The assembly of any of the preceding or subsequent examples, wherein the acoustic device comprises an acoustic speaker.

E17. The assembly of any of the preceding or subsequent examples, wherein the acoustic device comprises a flex circuit having a MEMS acoustic transducer thereon.

E18. The assembly of any of the preceding or subsequent examples, wherein the breathable layer comprises a ring.

E19. The assembly of any of the preceding or subsequent examples, wherein the breathable layer comprises one of a polymeric material, composite material, textile material, metallic material, ceramic material, or adhesive material capable of passing air therethrough.

E20. The assembly the preceding example, wherein the breathable layer has a positive, nonzero water entry pressure resistance.

E21. The assembly example 19, wherein the breathable layer has a water entry pressure resistance of not less than 0.2 psi.

E22. The assembly of any of the preceding or subsequent examples, wherein the breathable layer comprises a porous ePTFE layer.

E23. The assembly of any of the preceding or subsequent examples, wherein the breathable layer comprises a woven textile or woven textile composite.

E24. The assembly of any of the preceding or subsequent examples, wherein the breathable layer comprises a nonwoven textile or nonwoven textile composite.

E25. The assembly of any of the preceding or subsequent examples, further comprising a first adhesive layer between the first side of the nonporous membrane and at least a portion of the breathable layer.

E26. The assembly of any of the preceding or subsequent examples, further comprising a second adhesive layer between the breathable layer and the acoustic device.

E27. The assembly of any of the preceding examples, further comprising a third adhesive layer connecting the nonporous membrane with an interior surface of the housing.

E28. An acoustic equilibration assembly for an acoustic device, comprising a nonporous membrane in an acoustic pathway having a first side and a second side, the first side facing toward an acoustic cavity and the second side of the nonporous membrane facing toward an opening of the acoustic pathway, and a layered assembly defining walls of the acoustic cavity, the layered assembly comprising a breathable layer, wherein a first side of the breathable layer is attached with at least a portion of the first side of the nonporous membrane, and a second side of the breathable layer is configured to attach with an acoustic device, and wherein the breathable layer provides an airflow into or out of the acoustic cavity of not greater than 500 mL/min at 6.9 kPa to equalize pressure between the acoustic cavity and an environment outside of the acoustic cavity.

E29. The assembly of any of the preceding or subsequent examples, further comprising a channel fluidly connecting the acoustic cavity with a portion of the breathable layer that partially defines a venting pathway, the venting path being laterally offset from an acoustic pathway.

E30. The assembly of the preceding example, further comprising an adhesive layer connected between the breathable layer and the acoustic device, wherein the adhesive layer comprises the channel.

E31. The assembly of any of the preceding examples, further comprising a gasket connected between the breathable layer and the acoustic device, wherein the gasket comprises the channel.

E32. The assembly of any of the preceding or subsequent examples, wherein the layered assembly defines walls of a venting pathway, the breathable layer being disposed across the venting pathway such that air passing through the venting pathway passes through at least a portion of the breathable layer.

E33. The assembly of any of the preceding or subsequent examples, wherein the venting pathway fluidly connects the acoustic cavity with an environment outside of the acoustic cavity, so as to equalize pressure between the acoustic cavity and the environment outside of the acoustic cavity.

E34. The assembly of the preceding example, further comprising a housing containing the nonporous membrane, layered assembly, and acoustic device, wherein the acoustic pathway connects with an exterior of the housing through an opening in the housing, and the venting pathway connects the acoustic cavity with an interior environment of the housing.

E35. The assembly of any of the preceding or subsequent examples, having an insertion loss peak of not greater than 30 dB.

E36. The assembly of any of the preceding or subsequent examples, wherein the airflow into or out of the acoustic cavity is not greater than 250 mL/min at 6.9 kPa.

E37. The assembly of the preceding example, having an insertion loss peak of not greater than 30 dB.

E38. The assembly of any of the preceding or subsequent examples, wherein the airflow into or out of the acoustic cavity is not greater than 100 mL/min at 6.9 kPa.

E39. The assembly of the preceding example, having an insertion loss peak of not greater than 30 dB.

E40. The assembly of the preceding example, wherein the airflow into or out of the acoustic cavity is sufficiently high to prevent transducer bias.

E41. The assembly of the preceding example, wherein the airflow into or out of the acoustic cavity is sufficiently high to prevent a pressure difference that could otherwise impede an acoustic response of the nonporous membrane.

E42. The assembly of any of the preceding or subsequent examples, wherein the airflow into or out of the acoustic cavity is sufficient to prevent transducer bias.

E43. The assembly of any of the preceding examples, wherein the airflow into or out of the acoustic cavity is sufficiently high to prevent a pressure difference that could otherwise impede an acoustic response of the nonporous membrane.

What is claimed is:

1. An acoustic equilibration assembly for an acoustic device, comprising:

a nonporous membrane in an acoustic pathway having a first side and a second side, the first side facing toward an acoustic cavity and the second side of the nonporous membrane facing toward an opening of the acoustic pathway; and a layered assembly defining walls of the acoustic cavity, the layered assembly comprising a breathable layer, wherein a first side of the breathable layer is attached with at least a portion of the first side of the nonporous membrane, and a second side of the breathable layer is configured to attach with an acoustic device, and wherein the breathable layer provides an airflow into or out of the acoustic cavity of not greater than 500 mL/min at 6.9 kPa to equalize pressure between the acoustic cavity and an environment outside of the acoustic cavity.

2. The assembly of claim 1, further comprising:

a housing having an opening for passing acoustic waves between an exterior environment and the opening of the acoustic pathway; and the acoustic device, wherein the acoustic device is contained within the housing and positioned adjacent the acoustic cavity.

3. The assembly of claim 2, wherein the environment outside of the acoustic cavity comprises an interior environment of the housing.

4. The assembly of claim 1, wherein the acoustic device comprises one of a micro-electric mechanical (MEMs) microphone, transducer, acoustic speaker, or flex circuit having a MEMS acoustic transducer thereon.

5. The assembly of claim 1, wherein the breathable layer comprises a ring.

6. The assembly of claim 1, wherein the breathable layer comprises one of a polymeric material, composite material, textile material, metallic material, ceramic material, or adhesive material capable of passing air therethrough.

7. The assembly of claim 1, wherein the breathable layer has a positive, nonzero water entry pressure resistance.

8. The assembly of claim 1, wherein the breathable layer comprises a porous ePTFE layer.

9. The assembly of claim 1, wherein the breathable layer comprises one of a woven textile, woven textile composite, nonwoven textile, or nonwoven textile composite.

10. The assembly of claim 1, further comprising a channel fluidly connecting the acoustic cavity with a portion of the breathable layer that partially defines a venting pathway, the venting path being laterally offset from an acoustic pathway of the acoustic cavity.

11. The assembly of claim 10, further comprising an adhesive layer connected between the breathable layer and the acoustic device, wherein the adhesive layer comprises the channel.

12. The assembly of claim 10, further comprising a gasket connected between the breathable layer and the acoustic device, wherein the gasket comprises the channel.

13. The assembly of claim 1, wherein the layered assembly defines walls of a venting pathway, the breathable layer being disposed across the venting pathway such that air passing through the venting pathway passes through at least a portion of the breathable layer.

14. The assembly of claim 1, wherein the assembly has an insertion loss peak of not greater than 30 dB.

15. The assembly of claim 1, wherein the airflow into or out of the acoustic cavity is not greater than 250 mL/min at 6.9 kPa.

* * * * *